US012746451B2

(12) United States Patent
Steinke

(10) Patent No.: US 12,746,451 B2
(45) Date of Patent: Sep. 29, 2026

(54) BINDING SYSTEM FOR A TOURING SKI BINDING

(71) Applicant: 5IVE SPORTS GMBH, Dölsach (AU)

(72) Inventor: Markus Steinke, Ascholding/Dietramzell (DE)

(73) Assignee: 5IVE SPORTS GMBH, Dolsach (AT)

( * ) Notice: Subject to any disclaimer, the term of this patent is extended or adjusted under 35 U.S.C. 154(b) by 261 days.

(21) Appl. No.: 18/722,893

(22) PCT Filed: Dec. 23, 2022

(86) PCT No.: PCT/EP2022/087681
§ 371 (c)(1),
(2) Date: Jun. 21, 2024

(87) PCT Pub. No.: WO2023/118549
PCT Pub. Date: Jun. 29, 2023

(65) Prior Publication Data

US 2025/0058200 A1 Feb. 20, 2025

(30) Foreign Application Priority Data

Dec. 23, 2021 (DE) ..... 10 2021 134 650

(51) Int. Cl.
*A63C 9/085* (2012.01)
*A63C 9/08* (2012.01)
*A63C 9/086* (2012.01)

(52) U.S. Cl.
CPC ..... *A63C 9/0807* (2013.01); *A63C 9/08535* (2013.01); *A63C 9/08571* (2013.01); *A63C 9/08592* (2013.01); *A63C 9/086* (2013.01)

(58) Field of Classification Search
CPC ... A63C 9/0807; A63C 9/08535; A63C 9/085; A63C 9/08571; A63C 9/08557; A63C 9/08592; A63C 9/086
See application file for complete search history.

(56) References Cited

U.S. PATENT DOCUMENTS 5,066,036 A 11/1991 Broughton
6,017,050 A 1/2000 Girard
(Continued)

FOREIGN PATENT DOCUMENTS

DE 694 07 060 3/1998
EP 0 768 103 4/1997
(Continued)

OTHER PUBLICATIONS

Examination Report for priority application DE 10 2021 134 650.9, 14 pages, dated Aug. 1, 2022.
(Continued)

*Primary Examiner* — John D Walters
(74) *Attorney, Agent, or Firm* — Ruggiero McAllister & McMahon LLC

(57) ABSTRACT

A binding system for a touring ski binding has a front jaw device and a rear jaw device for receiving a ski boot. In a descent mode, the front jaw device is open and the rear jaw device is closed, so that a retainer can receive a web of the ski boot, and a lever mechanism can fix a heel part of the ski boot. The rear jaw device with the lever mechanism exerts a contact pressure on the heel part of the ski boot along a boot longitudinal axis (X), so that the web is pressed into a hook system of the front jaw device, and the ski boot is thus secured against translation against the boot longitudinal axis (X).

20 Claims, 11 Drawing Sheets

(56) References Cited

U.S. PATENT DOCUMENTS

| | | | | |
|---|---|---|---|---|
| 6,467,796 | B1 | 10/2002 | Weltman et al. | |
| 6,986,526 | B2 * | 1/2006 | Haughlin | A63C 9/20 280/615 |
| 7,922,188 | B2 * | 4/2011 | Kogler | A63C 9/20 280/615 |
| 9,526,972 | B2 | 12/2016 | Steinke et al. | |
| 10,188,935 | B2 * | 1/2019 | Kreuzinger | A63C 9/0807 |
| 11,173,381 | B2 | 11/2021 | Bartl et al. | |

FOREIGN PATENT DOCUMENTS

| | | |
|---|---|---|
| EP | 3 207 964 | 8/2017 |
| EP | 2 987 538 | 1/2018 |
| FR | 2172925 | 10/1973 |

OTHER PUBLICATIONS

International Search Report for corresponding International (PCT) application No. PCT/EP2022/087681, 17 pages, dated Jun. 29, 2023.

* cited by examiner

BINDING SYSTEM FOR A TOURING SKI BINDING

TECHNICAL AREA

A binding system for a touring ski binding comprising a front jaw device and a rear jaw device for receiving a ski boot.

DESCRIPTION OF THE RELATED ART

Ski bindings for touring skis are primarily characterized by the fact that, compared to conventional ski bindings, they can be switched between an ascent mode and a descent mode. In ascent mode, only the front section of the ski boot is fixed to the ski so that the rear section of the ski boot can be lifted off the ski and placed on it. The front section of the ski boot rotates around a horizontal axis of a fastening web that is perpendicular to the longitudinal direction of the ski. In descent mode, both the front and rear sections of the ski boot are firmly fixed to the ski.

The descent performance of touring skis is generally limited by the need to provide an ascent function. For example, well-known touring binding systems generally have a higher standing height compared to pure descent binding systems. The components required for the ascent position also require a comparatively higher amount of material, which can lead to a higher weight of the touring bindings.

Conventional touring binding systems can be roughly divided into the categories of web binding systems and pin systems. The web binding systems are characterized by the fact that the ski boot is clamped between the front and rear jaws, both in the descent position and in the ascent position. The front and rear jaws are attached to a web, whereby the front part of the web is fixed to the ski in both the ascent and descent positions. In the ascent position, the front part of the web can rotate around a horizontal axis perpendicular to the longitudinal axis of the ski. The rear end can be fixed to the ski in the descent position and lifted off the ski in the ascent position. The web results in the disadvantages already mentioned of a higher standing height and comparatively higher weight.

With the pin systems, the bindings can be divided into a front unit and a rear unit. In the ascent position, the ski boot is only pivoted by the front unit around a horizontal pivot axis that runs perpendicular to the longitudinal axis of the ski. Known pin systems have the considerable disadvantage that lateral release behavior, in which the ski boot can release laterally from the binding in descent mode when an increased force is applied, is impaired by the pins penetrating into the ski boot.

OVERVIEW

Described is a binding system for a touring ski binding, comprising a front jaw device and a rear jaw device for receiving a ski boot, the ski boot having a heel part and a front foot part, at least one web being arranged in or on the front foot part, the web axis of the web extending perpendicular to the boot longitudinal axis, wherein the boot longitudinal axis extends from the heel part to the front foot part, wherein the front jaw device comprises a holding device with a retainer and a locking system, wherein the retainer has a hook-shaped receptacle for receiving the web of the ski boot, which is aligned opposite the boot longitudinal axis, wherein the retainer comprises the web at least partially and thus receives the web of the ski boot, wherein the locking system is suitable for locking the web of the ski boot in the retainer so that it can rotate about the web axis, wherein the rear jaw device has a lever mechanism which is suitable for fixing the heel part of the ski boot, wherein in an ascent mode of the touring ski binding, the front jaw device is closed and the rear jaw device is open, wherein the retainer can lock the web of the ski boot rotatable and the locking system can secure the web against translation against the boot longitudinal axis, wherein the rear jaw device does not fix the heel part of the ski boot, so that the ski boot can be rotated about the web axis. According to the disclosure, in a descent mode, the front jaw device is open and the rear jaw device is closed, so that the posture can accommodate the web of the ski boot and the lever mechanism of the rear jaw device can fix the heel part of the ski boot, wherein the rear jaw device with the lever mechanism exerts a contact pressure on the heel part of the ski boot along the boot longitudinal axis, so that the web is pressed into the retainer of the front jaw device, and thus the ski boot is secured against translation against the boot longitudinal axis.

The touring ski binding can be mounted on a ski, for example, using a screw connection. The ski surface normal, which is orthogonal to the boot longitudinal axis and orthogonal to the web axis, is perpendicular to the ski surface. The relative positions of the various parts of the touring ski binding are therefore described below using the aforementioned axes.

The ski boot has a heel section and a forefoot section. The heel part and the front foot part are located on the ski boot in accordance with the anatomy of a human foot. In particular, the heel part and the front foot part refer to the outermost areas of the ski boot. Accordingly, the boot longitudinal axis runs from the heel to the forefoot area of a foot, and thus corresponds to the typical walking direction of a person.

The heel part (and/or front foot part) of the ski boot can have a particularly mechanically resilient edge, which is suitable for transmitting a force, in particular a longitudinal holding force, to the ski boot in the direction of the boot's longitudinal axis. The edge can also protrude from the heel part of the ski boot against the boot longitudinal axis in order to ensure both a large surface area for the lever mechanism and to provide various surfaces for transverse holding forces, in particular transverse holding forces which act orthogonally to the boot longitudinal axis and parallel to the normal of the ski surface.

At least one web is arranged in or on the front foot part of the ski boot. The web is preferably a cylindrical component whose cylindrical axis runs perpendicular to the boot longitudinal axis. The cylindrical design of the web makes it particularly easy to rotate the ski boot in the front jaw device. This simple rotation makes it possible to guide the ski under the foot or boot in a particularly comfortable and joint-friendly manner during the natural movement sequence when walking. This leads to a stabilized gait in the terrain and thus also to increased safety.

However, it is also possible for the web to have a different geometric shape. For example, the web can have an elliptical cross-section or a partially round cross-section. However, the rounding of the web is always arranged in such a way that a low-friction rotation of the web in the front jaw device is possible and/or particularly advantageous power transmission of the web to the ski, for example, when lifting the ski and when driving the ski, is made possible. In particular, it can be taken into account that the ski boot does not have to be rotated completely around the web axis, but only a limited angle range must have the advantageous properties due to the natural movement process when walking.

The web has a finite length, which is typically smaller than the width of the forefoot. The web can be fully or partially embedded in the sole of the ski boot or lie completely outside the sole and be attached to the ski boot, for example with a stiffened web holding construction. A translation along the web axis is limited in the front jaw device either by the sole or by the web retaining structure of the ski boot. Ideally, the ski boot held in the front jaw device cannot be moved in translation along the web axis, e.g., displaced.

The hook-shaped receptacle of the retainer can be adapted to the curvature or geometric shape of the web, so that form-fit contact between the web and the retainer is possible. This allows a particularly stable and rigid connection between the ski boot and the front jaw device, so that the ski can be controlled particularly well.

In particular, the retainer at least partially encompasses the web.

In particular, this can mean that a hook forming the hook-shaped receptacle is only suitable for providing a transverse holding force and a longitudinal holding force. For example, in the case of a cylindrical web, the retainer can only extend from the top of the web to the front of the web (viewed in the direction of the boot longitudinal axis in the plane of the boot longitudinal axis and ski surface normal). As a result, a transverse holding force parallel to the ski surface normal can be generated, and a longitudinal holding force can also be generated along the boot longitudinal axis. A holding force along the negative ski surface normal is realized by the ski surface so that the retainer does not have to encompass the lower area of the web.

The web is therefore accommodated by the retainer when the translation of the ski boot along the positive ski surface normal and along the boot longitudinal axis is prevented.

The hook-shaped receptacle for holding the web of the ski boot is aligned against the boot longitudinal axis.

Irrespective of the shape of the web, at least one translation of the ski boot in the direction of the boot's longitudinal axis can be prevented, as the hook serves as a mechanical barrier for the web.

Furthermore, the translation of the ski boot against the direction of the ski surface normal can be prevented. This can be achieved either by shaping the retainer or by the locking system.

Alternatively, the retainer with a hook-shaped receptacle can also be designed in the form of a hook system with an opening.

The locking system is arranged in front of the retainer on the ski in the direction of the boot's longitudinal axis. In particular, the retainer can prevent the web from translating against the boot longitudinal axis. Together with the mounting by the retainer, a translation of the ski boot perpendicular to the web axis can thus be prevented overall. As already described above, the translation of the ski boot along the web axis is also prevented by design. However, the ski boot held and locked in the retainer can be rotated around the web axis.

The rear jaw device has a lever mechanism that is suitable for fixing the heel part of the ski boot. For example, the lever mechanism can exert a longitudinal holding force on the ski boot, such as pressing the ski boot along the boot longitudinal axis into the retainer of the front jaw device. A transverse holding force that presses the heel part of the ski boot in the direction of the ski surface is also useful.

A lever mechanism can mean that the lever mechanism comprises at least two components that are movably attached to each other and can be moved against each other in order to create a holding force on the ski boot. In particular, a movable attachment can mean that the components of the lever mechanism can be rotated and/or moved.

The binding system for a touring ski binding has two modes, namely, an ascent mode and a descent mode. The ascent mode of the touring ski binding is suitable for walking or climbing with the ski attached to the ski boot, in particular for climbing a mountain or slope. The descent mode, on the other hand, is suitable for attaching the ski to the ski boot so that a safe descent with a high level of ski control is possible.

In the ascent mode, the front jaw device is closed, and the rear jaw device is open. A closed front jaw device can mean that the front jaw device can lock the web in a rotatable manner, whereby the locking system can secure the web against translation against the longitudinal axis of the shoe, as already described above. In addition, the rear jaw device is open in ascent mode. As a result, the rear jaw device does not fix or hold the heel part of the ski boot, so rotation of the ski boot about the web axis is made possible in the first place.

In descent mode, the front jaw device is open, and the rear jaw device is closed. An open front jaw device can mean that only the retainer can hold the web of the ski boot, but the locking system does not lock the web in a rotatable position. An open front jaw device, therefore, makes it possible to guide the web into the retainer or to remove the web from the retainer. This allows the boot to be released from the binding, in particular from the front jaw device, especially in the event of a fall in descent mode.

To hold the ski boot securely in descent mode, the lever mechanism of the rear jaw device can fix the heel part of the ski boot. Here, the rear jaw device with the lever mechanism exerts contact pressure on the heel part of the ski boot along the boot longitudinal axis, as already described above. The contact pressure presses the web into the retainer of front jaw device. The retainer, therefore, secures the web in descent mode against translation in the direction of the boot longitudinal axis and along the ski surface normal. At the same time, the web is secured against translation against the boot longitudinal axis by the lever mechanism pressing the heel part of the ski boot in the direction of the boot longitudinal axis. In descent mode, the ski boot, therefore, cannot be rotated but is fixed in its position relative to the ski.

The binding system for a touring ski binding, therefore, has the advantage that the ski boot can be moved in an ascent mode in the same way as a cross-country ski boot. At the same time, a high level of stability and safety can be guaranteed in descent mode, as the ski boot can be held firmly in the touring ski binding. At the same time, however, the retainer allows the ski boot to be released from the open front jaw device in descent mode so that injuries in the event of a fall can be avoided or reduced.

In an embodiment, the locking system and the retainer are moved relative to each other during locking. Both the locking system and the retainer can be moved. Alternatively, only the locking system or the retainer can be displaced. In particular, a relative displacement means that the locking system and the retainer are not rotated relative to each other. Advantageously, the locking system and the retainer are displaced relative to each other along the boot longitudinal axis, in particular parallel to the plane of the ski surface.

This allows the retainer and the locking system to be moved towards each other, so that a rotatable locking of the web between the locking system and the retainer is possible.

In a further development, the locking system is fixed to the ski, and the retainer can be moved.

As a result, only the retainer can be moved in the aforementioned manner. In particular, the retainer can be moved towards or away from the locking system.

For example, in a closed mode of the front jaw device, the retainer is arranged adjacent to the locking system, while in an open mode it is arranged at a distance from the locking system. In particular, the two types of retainers are thus spatially separated by the retainer in the descent mode and in the ascent mode. This enables a particularly simple construction of the binding system.

In a further embodiment, the front jaw device further comprises a front jaw lever mechanism, wherein the retainer is displaceable by means of the front jaw lever mechanism.

As described above, a front jaw lever mechanism can exert a force along or against the longitudinal axis of the shoe by rotating components of the mechanism around their attachment points. In particular, the (rotational) forces acting on the lever are therefore redirected to a transverse force, preferably a transverse holding force, by the front jaw lever mechanism.

A front jaw lever mechanism can move the retainer in the direction of the locking system by actuating a lever. For example, the lever of the front jaw lever mechanism can have two positions, so that a closed and an open state of the front jaw device can be realized.

In a further embodiment, the front jaw device further comprises a front jaw spring mechanism, wherein the retainer is displaceable by means of the front jaw spring mechanism.

The retainer can also be displaced by a front jaw spring mechanism. In particular, the front jaw device can be pre-tensioned by the front jaw spring mechanism. In this case, a spring can be arranged between the locking system and the retainer, whereby the spring can push the retainer and the locking system away from each other. However, it is also possible for the spring to move the retainer and the locking system towards each other.

For example, a lever position of the front jaw lever mechanism can bring the front jaw device into a closed state. Then a front jaw lever mechanism can be used as a safety release, for example, if the spring is preloaded by the closed state of the front jaw device. In particular, in this example, the spring would push the locking system and the bracket away from each other. Finally, if a force acts on the front jaw device, such as occurs in a fall, then the bracket can be pushed away from the locking system by the front jaw spring mechanism, allowing the web and the ski boot to release from the front jaw device. In particular, this allows a safety release to be realized in ascent mode.

Alternatively, the spring can be arranged in such a way that the retainer and the locking system are displaced in relation to each other. The spring is in a tensioned state when the lever position of the front jaw lever mechanism is in a closed state. In this way, the spring serves as a safety release in both descent mode and ascent mode. If a force in the direction of the boot longitudinal axis exceeds a predefined threshold value, for example in the event of a fall, the retainer is pushed away from the locking system and the web and the ski boot can be released from the front jaw device.

In a further embodiment, the locking system has a stop, whereby in ascent mode the retainer is pressed against the stop by means of the front jaw spring mechanism.

This allows the bracket and the locking system to be set to a predefined distance so that the bracket can lock the web in a rotatable manner.

In a further embodiment, the mount is U-shaped or L-shaped. This has the advantage that the parallel sides of the U-shaped retainer secure the web of the ski boot against translation along or against the ski surface normal. In addition, the curvature of the U-shaped retainer allows a round web to rotate when it is held in the U-shaped retainer. The U-shaped design of the retainer is particularly advantageous for the use of a hook system. The alternative design with an L-shaped retainer enables rotation of the web of the ski boot in ascent mode, whereby in ascent mode and in descent mode the web is still secured against translational movement along or against the ski surface normal. Furthermore, an L-shaped mount is advantageous in terms of production.

In a further development, the locking system comprises a locking plate which is configured to at least partially cover the hook-shaped receptacle of the retainer. This means that the locking mechanism, or the element that locks the web and restricts the web in its translational degrees of freedom, can be attached separately from the locking system and its underlying mechanism.

In particular, a locking plate can be rectangular so that the U-shaped retainer can be closed over its entire surface. However, the locking plate can also have a pronounced curve against the longitudinal axis of the shoe, so that the web is positively held and rotatable locked by the locking plate and the retainer. An L-shaped locking plate is advantageous when using an L-shaped retainer, as this holds the web in the hook-shaped receptacle in a force-locking manner and locks it in a rotatable manner. This form-fit design enables better power transmission in ascent mode.

According to a further embodiment, the web of the ski boot is offset along or against the boot longitudinal axis in ascent mode compared to descent mode. This can be achieved in particular by the retainer being located behind the locking system in the direction of the boot longitudinal axis in the open position of the front jaw device.

Due to the different positions of the ski boot relative to the ski, a better balance can be achieved in descent mode and in ascent mode, thus reducing the risk of injury and increasing skiing and ascent fun.

In an embodiment, the rear jaw device has a safety release in descent mode. A safety release enables, for example, the release of the rear jaw device when a predefined force is exceeded, i.e. switching the rear jaw device from a closed to an open state. This allows the ski boot to release from the rear jaw device in descent mode, minimizing the risk of injury in the event of a fall.

BRIEF DESCRIPTION OF THE FIGURES

Embodiments of the disclosure are explained in more detail in the following description of the figures. They show.

DETAILED DESCRIPTION

In the following, embodiments are described with reference to the figures. Here, identical, similar, or similarly acting elements in the different figures are provided with identical reference signs, and a repeated description of these elements is partially dispensed with in order to avoid redundancies.

Figure 1:
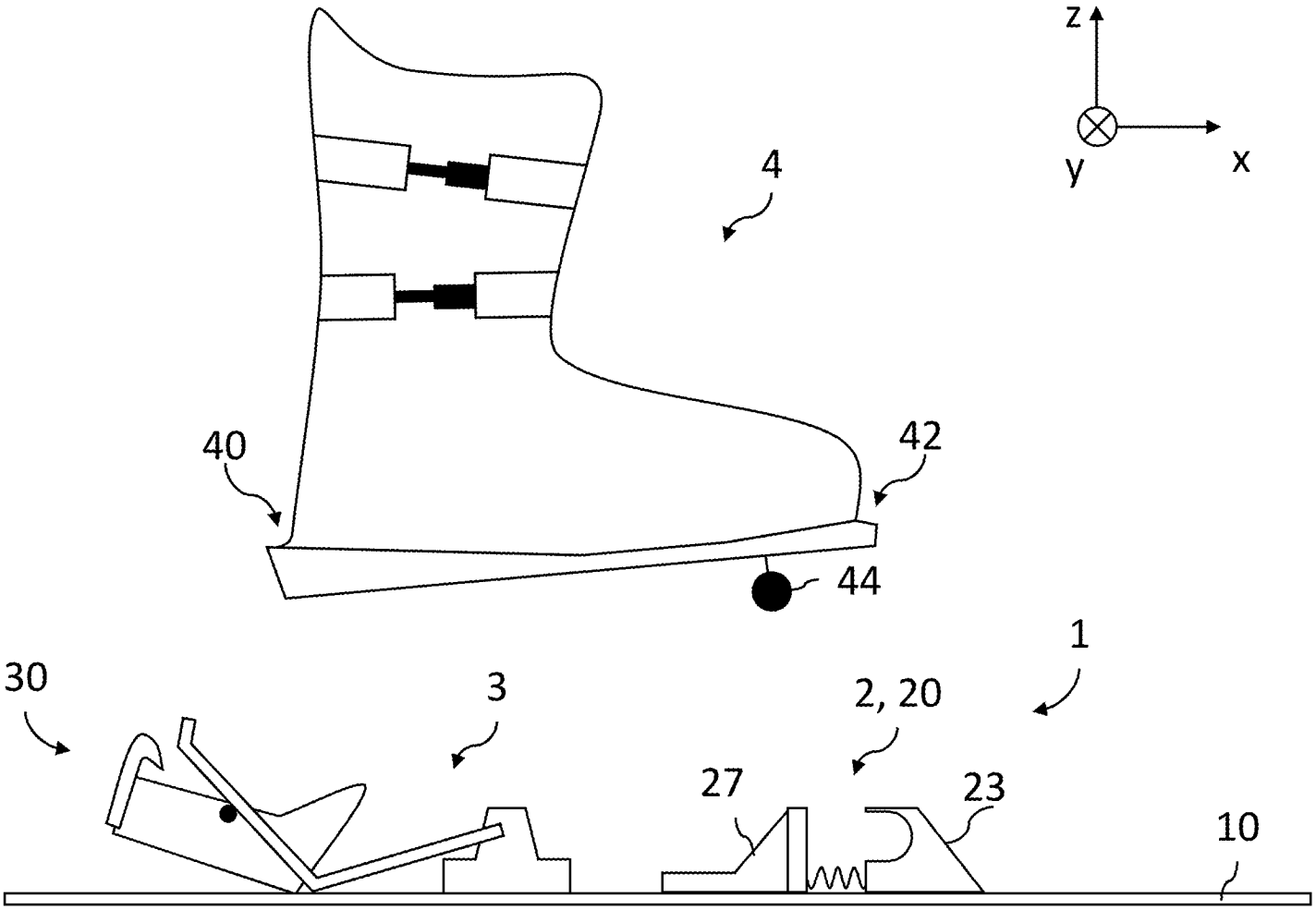
FIG. 1 schematic overview of the binding system for a touring ski binding.

FIG. 1 shows an overview of the binding system 1 for a touring ski binding. The binding system comprises a front jaw device 2 and a rear jaw device 3 for holding a ski boot 4.

The binding system 1 is mounted on a ski 10, for example, by means of a screw connection. The surface of the ski on which the binding system is mounted has a surface normal, which is called the ski surface normal Z.

The ski boot 4 has a heel section 40 and a front foot part 42. The so-called boot longitudinal axis X extends from the heel part 40 to the front foot part 42. The ski boot 4 also has a web 44 in the front foot part 42. The web 44 is preferably cylindrical in shape and extends in particular with the circular cross-section perpendicular to the plane formed by the ski surface normal Z and the boot longitudinal axis X. Accordingly, the axis of symmetry of the web 44 is the so-called web axis Y, which extends into the blade plane.

In the present example, the web 44 is arranged so that it is entirely below the sole of the ski boot 4. However, the web 44 can also be arranged at other positions of the front foot part 42, as shown in FIGS. 2A-2E.

Figure 2A:
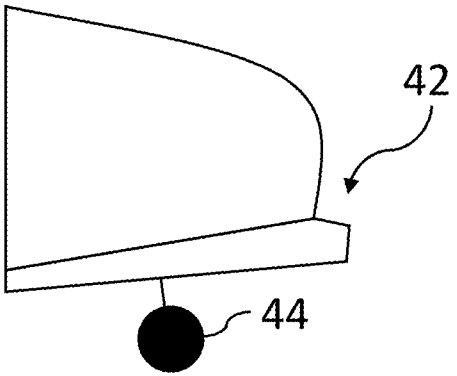
FIGS. 2A-2E various possible arrangements of the web on the ski boot.
Figure 2B:
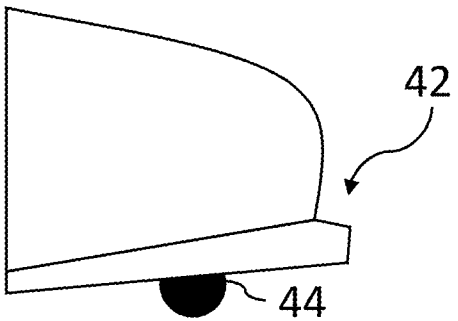
Figure 2C:
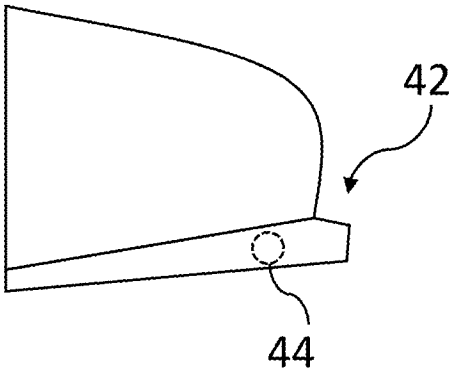
Figure 2D:
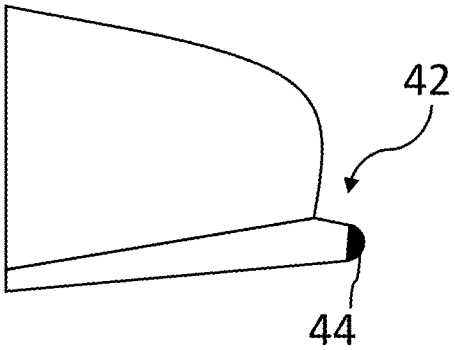
Figure 2E:
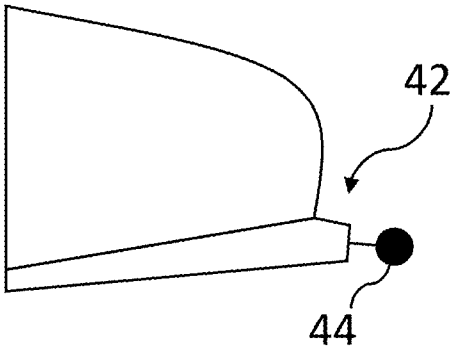

For example, FIG. 2A shows that the web 44 is arranged completely below the sole. FIG. 2B shows that the web 44 is partially arranged below the sole. FIG. 2C shows that the web 44 is completely integrated into the sole. FIG. 2D shows that the web is partially integrated into the front end of the front foot part 42. Alternatively, the web can also be fully integrated into the front end of the front foot part (not shown). FIG. 2E also shows that the web is arranged in front of the front end of the front foot part 42. Depending on the configuration, particularly ergonomic riding and climbing properties of the binding system can be achieved.

The front jaw device 2 of FIG. 1 further comprises a holding device 20, which comprises a retainer 21 and a locking system 27, and which is shown in a higher level of detail in FIGS. 3A-4D.

The retainer 21 of the front jaw device 2 has a hook-shaped receptacle 22, which is shaped in the form of a hook system 23 with an opening 24, wherein the opening 24 points against the longitudinal axis X of the boot. In particular, the opening 24 of the hook system 23 can partially encompass the web 44 of the ski boot 4 and thus, the hook system 23 can accommodate the web 44 of the ski boot 4. The opening 24 is U-shaped in this case, so that a secure hold of the web 44 in the hook system 23 is ensured.

Furthermore, the front jaw device 2 has a locking system 202 with which the web 44 of the ski boot 4 can be rotatable locked in the hook system 23. In particular, a rotatable locking means that a translation of the web 44 is to be prevented. The hook system 23 can, for example, prevent translation in the direction of the boot longitudinal axis X and in the direction of the ski surface normal Z. At the same time, translation against the ski surface normal Z can be prevented by the ski 10 itself or by the hook system 23. The locking system 27 can prevent the web 44 from translating against the direction of the boot longitudinal axis X. The translational degrees of freedom in and against the web axis Y are realized by the web 44 itself and its attachment in or on the sole. Accordingly, only one rotational degree of freedom around the web axis Y remains for the web 44.

For example, by the web 44 being round, or at least rounded, or round in sections, the rotational degree of freedom is not restricted by the hook system 23, but rather granted.

Figure 3A:
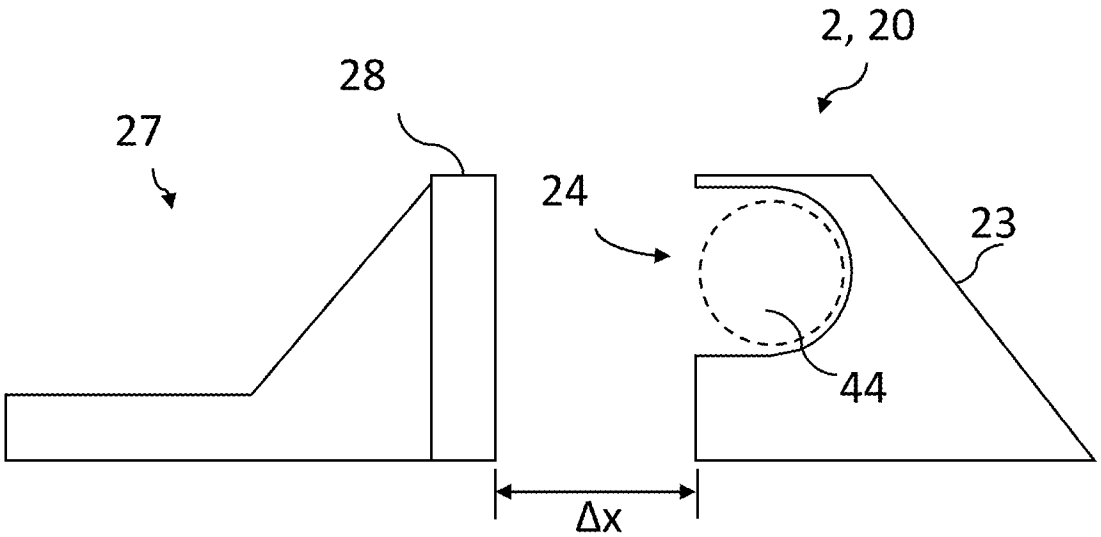
FIGS. 3A-3E schematic detailed view of the front jaw device.
Figure 3A:
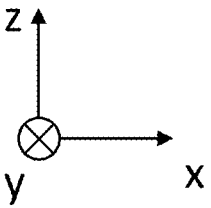
Figure 3B:
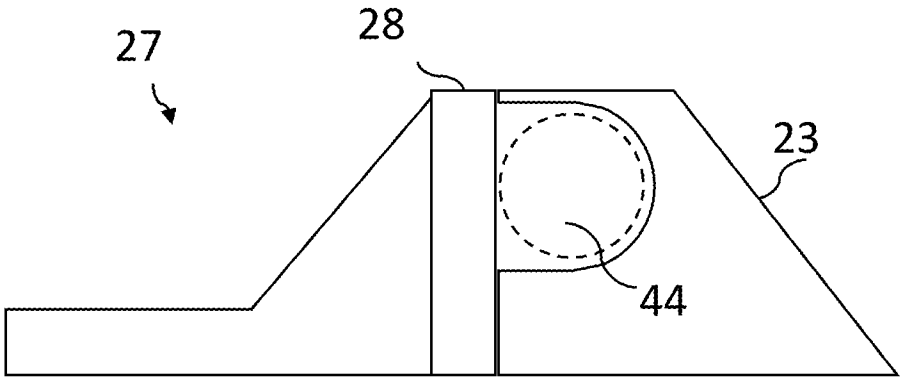

The locking of the locking system 27 is characterized by the fact that the hook system 23 is displaced relative to the locking system 27. FIG. 3A shows the length Ax of the relative displacement along the longitudinal axis X of the shoe.

Furthermore, the locking system 27 comprises a locking plate 28, which is arranged between the locking system 27 and the hook system 23. The locking plate 28 can enable a particularly advantageous rotatable locking mechanism if, for example, a particularly stable locking mechanism is enabled or a particularly low-friction locking mechanism is enabled. In particular, the locking plate 28 can also be formed in one piece with the locking system 27 (FIGS. 4A to 4D) or have a rounding corresponding to the web 44, so that the web 44 can be held in a form-fitting manner by the hook system 23 and the locking system 27 (not shown).

Figure 3C:
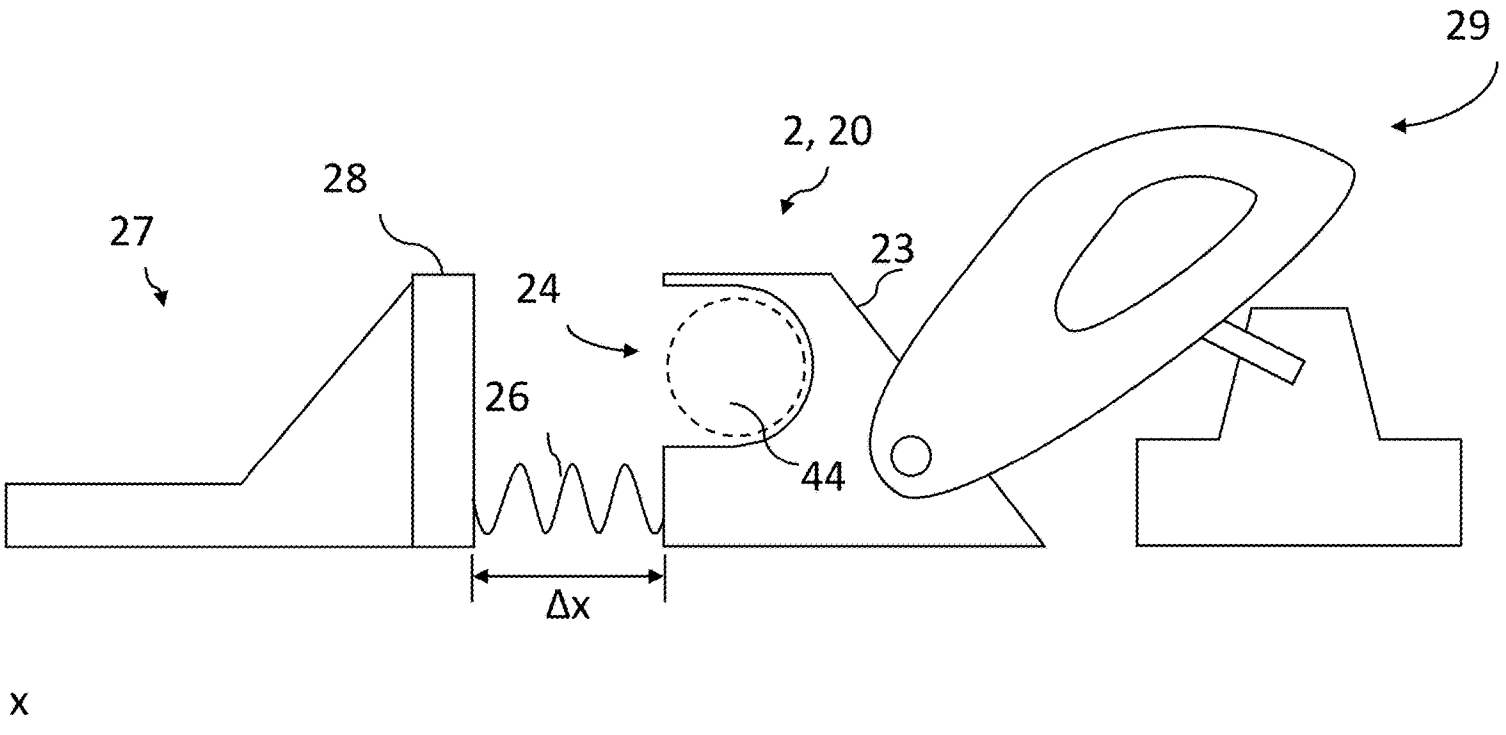
Figure 3D:
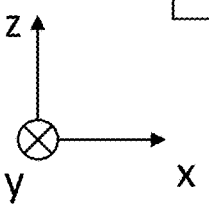
Figure 3D:
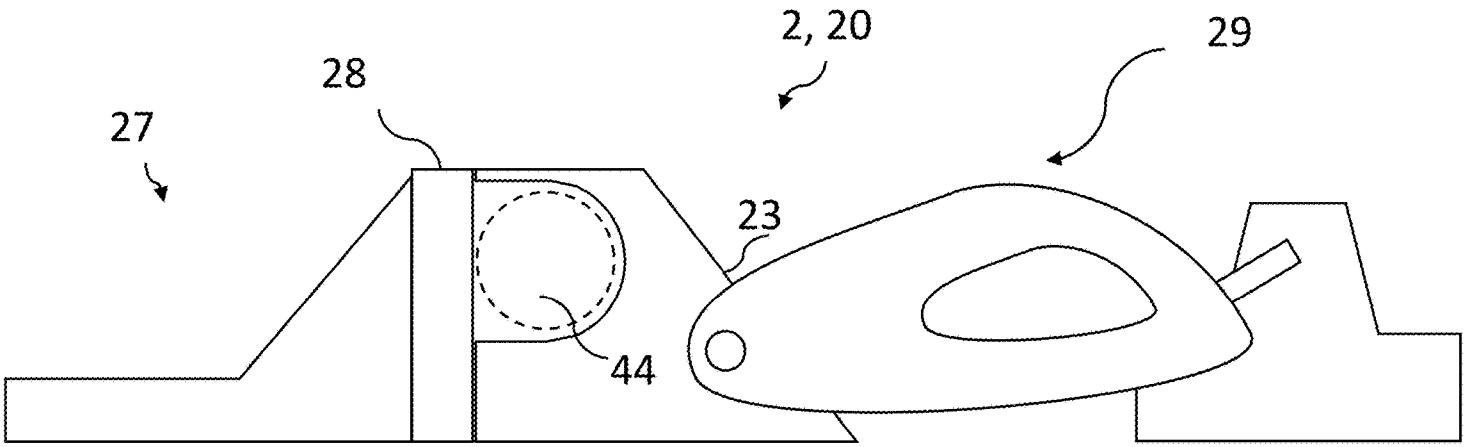

FIGS. 3C and 3D show further embodiments of the front jaw device 2. In particular, the locking system 27 is fixed to the ski 10, while the hook system 27 can be moved. In particular, a front jaw lever mechanism 29 and a front jaw spring mechanism 26 are shown, with the aid of which the hook system 23 can be displaced.

In FIG. 3C, the front jaw device 2 is open and the hook system 23 and the locking system 27 are pushed apart by the front jaw spring mechanism 26. By actuating the front jaw lever mechanism 29, on the other hand, a force can be built up against the spring force of the front jaw spring mechanism 26, so that the hook system 23 can be moved towards the locking system 27. The closed state of the front jaw device 2 is shown in FIG. 3D.

In the event of a fall, for example, the front jaw lever mechanism 29 can be released and quickly opened by the front jaw spring mechanism 26. As a result, the web 44 is no longer held in the hook system 23, whereby the ski boot 4 can be released from the binding system 1 for a touring ski binding, so that injuries to the ski can be avoided. Accordingly, a safety release in an ascent mode of the binding system 1 for a touring ski binding can be realized by such a mechanism.

Figure 3E:
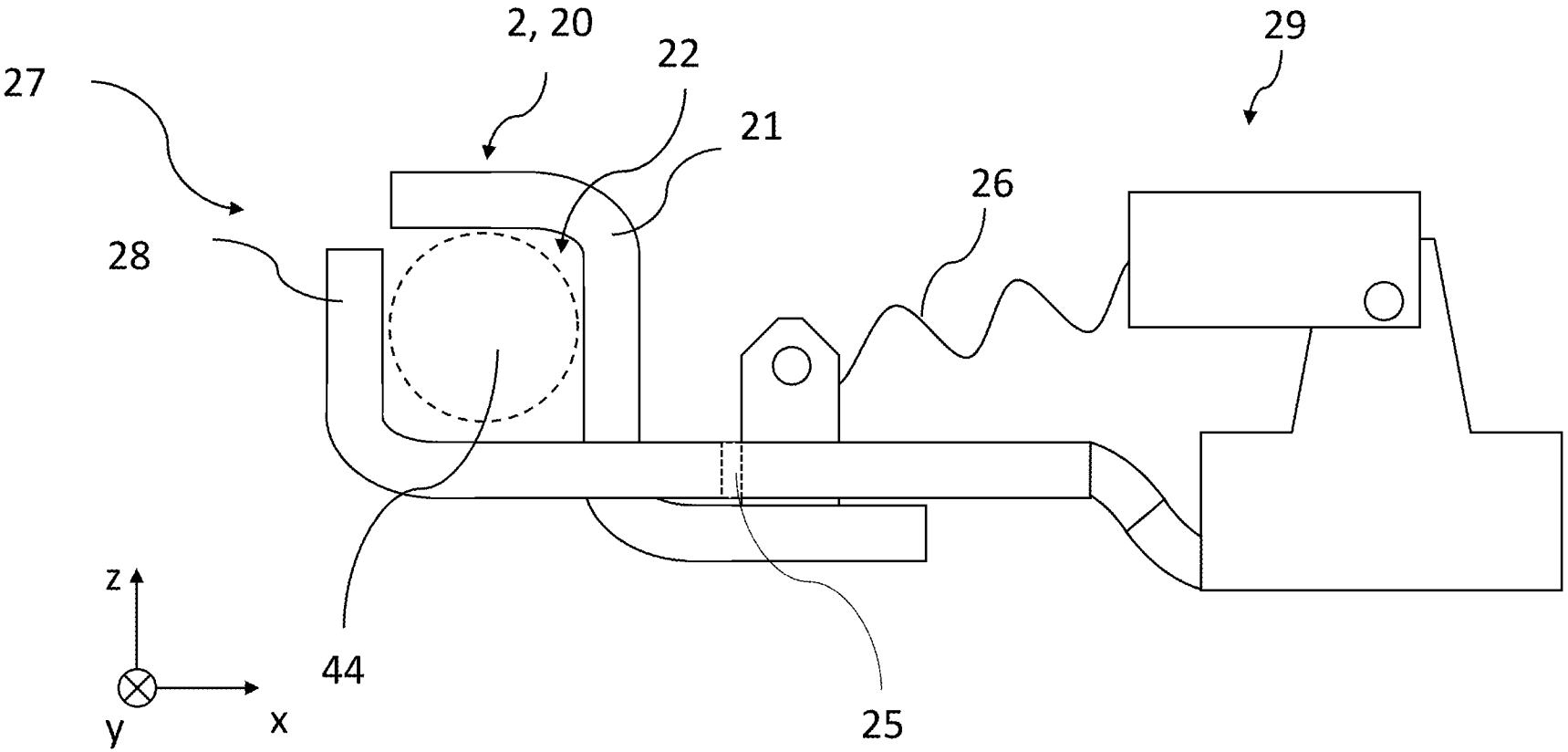

FIG. 3E shows an alternative embodiment of a front jaw device 2, wherein an L-shaped retainer 21 has a hook-shaped receptacle 22 for receiving a web 44, partially encloses it and thus, receives it. A likewise L-shaped locking plate 27 of a locking system 27 is suitable for locking the web 44 in the retainer 21 so that it can rotate about the web axis Y. If the lever position of a front jaw lever mechanism 29 is in a closed state, a spring of a front jaw spring mechanism 26 presses the retainer 21 against a stop 25 of the locking system 27, so that the web 44 is rotatable locked in the retainer 21 of the front jaw spring mechanism 26 and is secured by the locking system 27 against translation against the longitudinal axis X of the shoe.

Figure 4A:
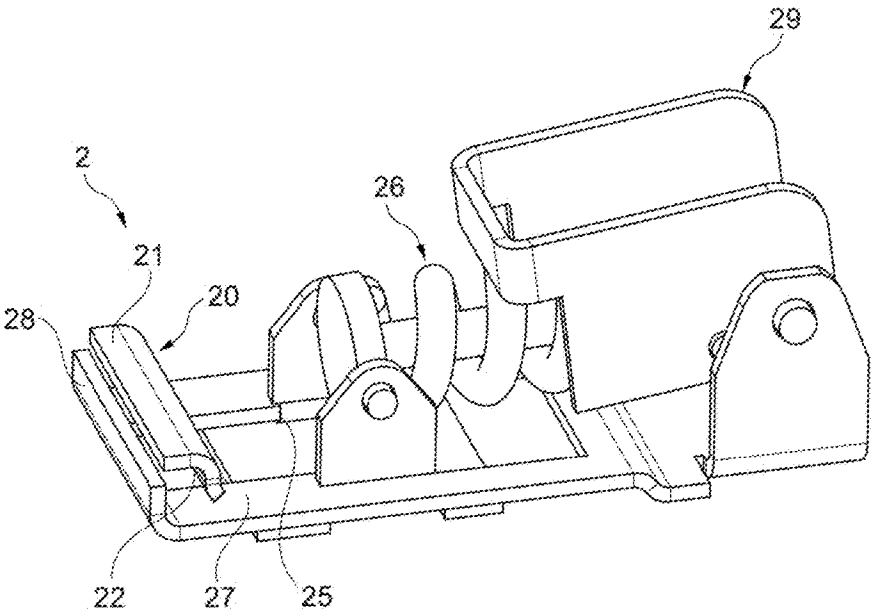
FIGS. 4A-4D schematic detailed view of alternative front jaw devices.
Figure 4B:
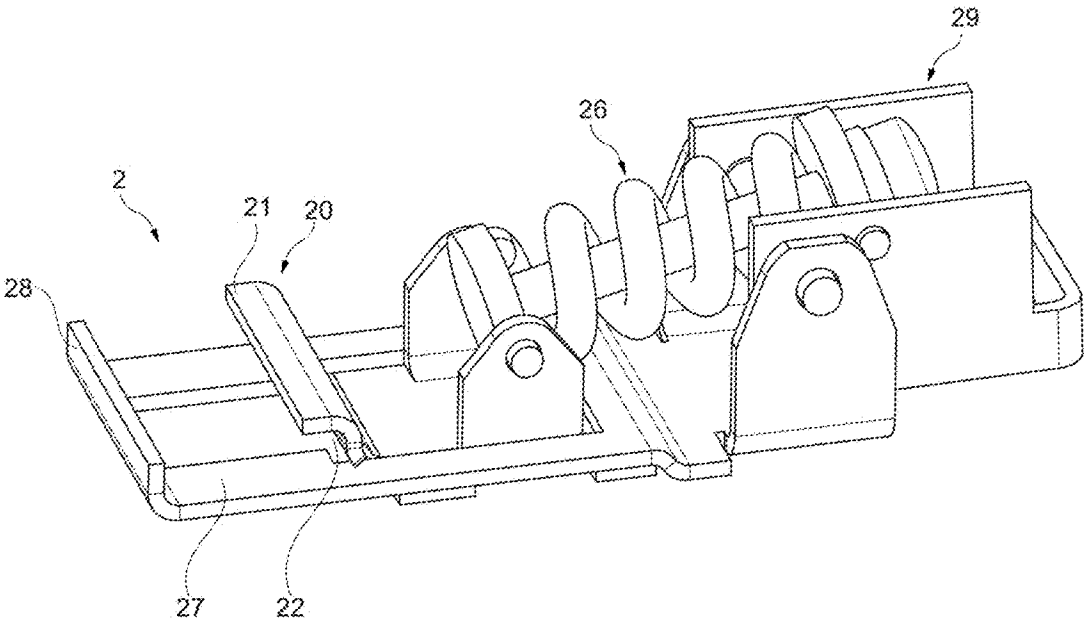

FIGS. 4A and 4B show a detailed view of an alternative embodiment of a front jaw device 2. FIG. 4A shows a front jaw device 2 in the ascent mode. Here, the lever position of the front jaw lever mechanism 29 is in a closed state, so that the retainer 21 is pressed against a stop 25 by means of the spring of the front jaw spring mechanism 26. The L-shaped retainer 21 and the L-shaped locking plate 28 of the locking system 27 can thus lock the web in a rotatable manner. In descent mode, which is shown in FIG. 4B, the retainer 21 is moved along the longitudinal axis X of the shoe via the front jaw spring mechanism 26 and the front jaw lever mechanism 29. The retainer 21 with the hook-shaped receptacle 22 can secure the web 44 against translation along the shoe axis X by the force Fx by pressing the web 44 into the retainer 21. The spring is in the un-tensioned state, whereby it brings the retainer 21 into a position via a safety mechanism at a predefined force in the direction of the longitudinal shoe axis X, so that the retainer 21 can release the web 44.

Figure 4C:
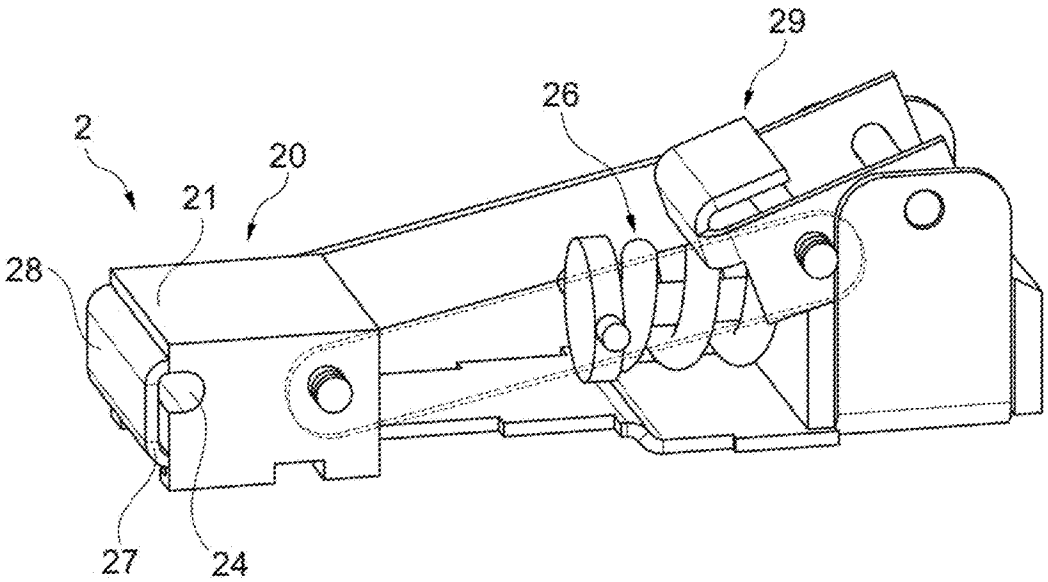
Figure 4D:
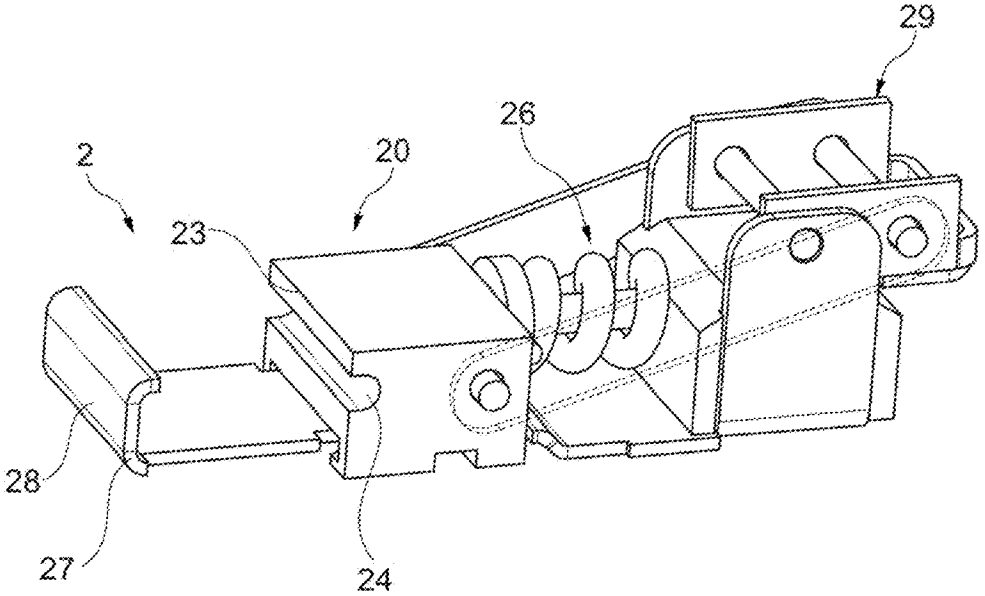

FIGS. 4C and 4D show a detailed view of a further alternative embodiment of the front jaw device 2. In FIG. 4C, the front jaw device 2 is in the ascent mode, wherein the front jaw lever mechanism 29 displaces the U-shaped hook system 23 against the shoe longitudinal axis X in the direction of the locking plate 28 of the stationary locking system 27 to such an extent that the opening 24 is at least partially covered by the locking plate 28 and thus the hook system 23 can lock the web in a rotatable manner, wherein the locking plate 28 can secure the web 44 against translation against the shoe longitudinal axis X. Accordingly, the retainer 21 is displaced along the longitudinal axis X of the shoe by the front jaw lever mechanism 26, so that the hook system 23 contacts the spring jaw spring mechanism 26. The hook system 23 can secure the web 44 against translation along the shoe axis X by the force Fx by pressing the web 44 into the hook system 23. The spring is in the untensioned state, whereby it brings the hook system 23 into a position via a safety mechanism at a predefined force in the direction of the longitudinal shoe axis X, so that the hook system 23 can release the web 44.

Figure 5A:
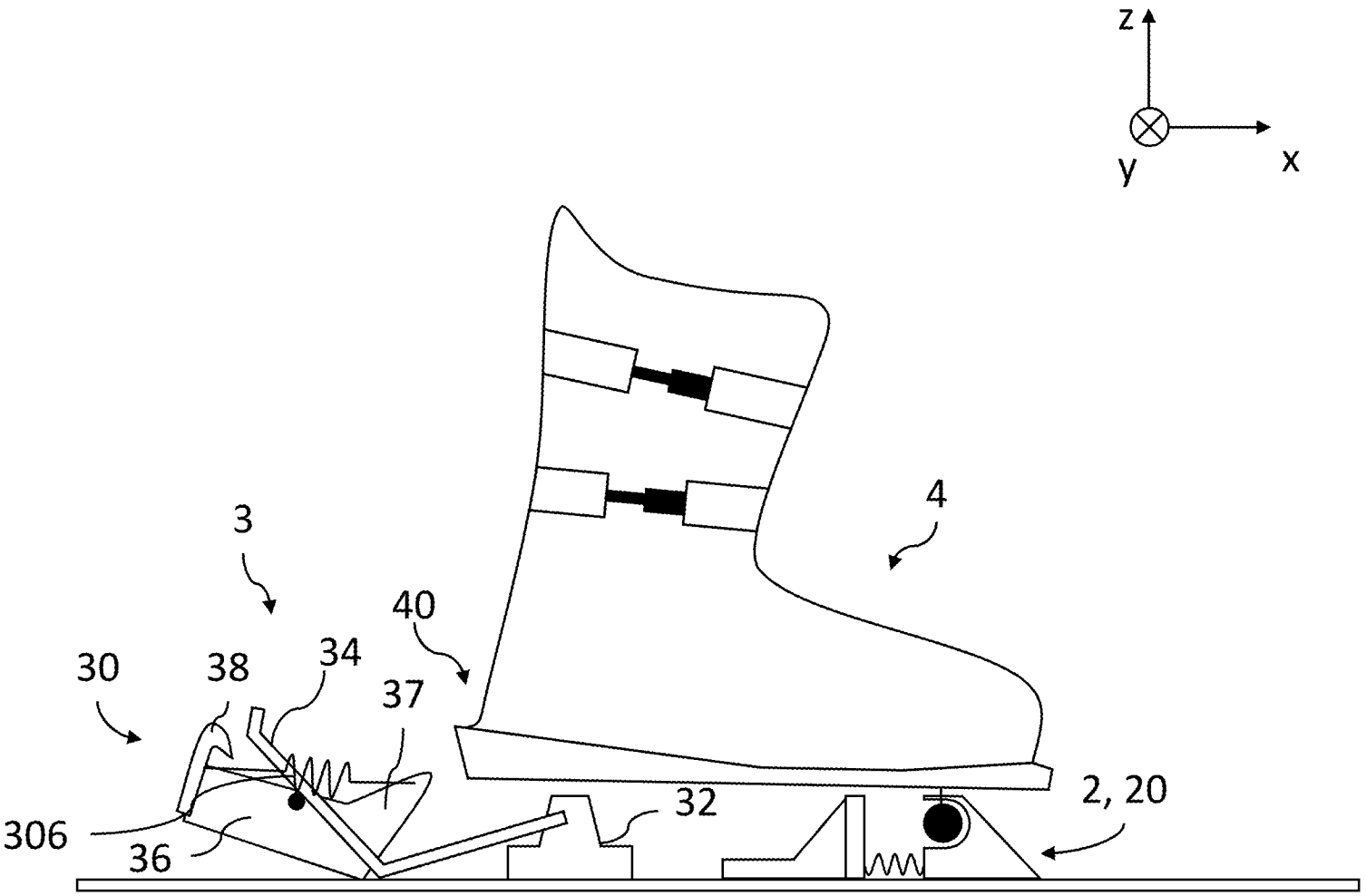
FIGS. 5A-5C schematic representation of the departure mode.
Figure 5B:
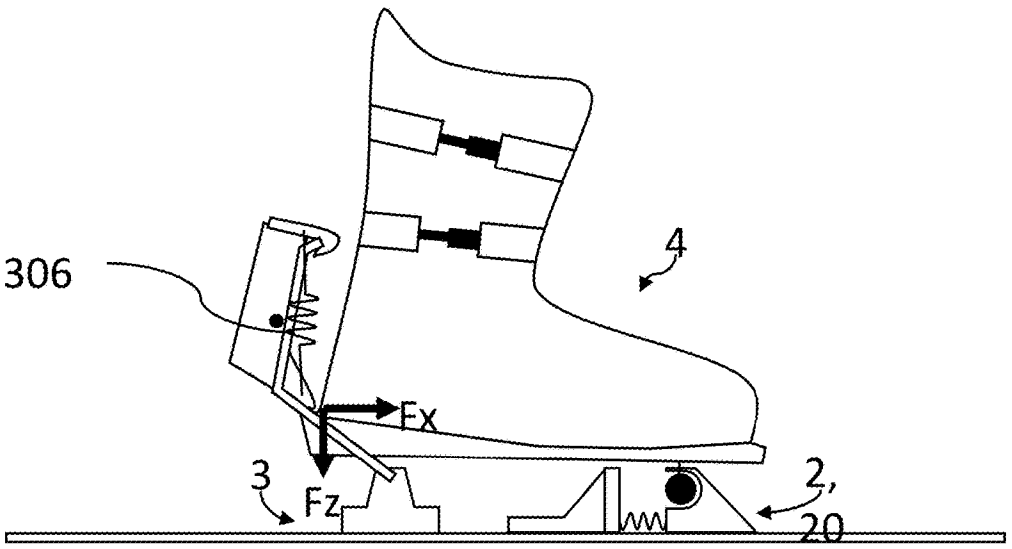

The detailed operation of the lever mechanism 30 shown in FIG. 1 is shown in FIGS. 5A and 5B. The lever mechanism 30 is suitable for fixing the heel part 40 of the ski boot 4. The lever mechanism 30 comprises a base 32 to which a lever 34 is rotatable attached, i.e. can be pivoted about the base 32. A clamping block 36 is rotatable attached to the lever 34, which has a clamping lug 37 at one end and a clamping hook 38 at the other end. If the heel part 40 of the ski boot 4 is to be fixed with the rear jaw device 3, the lever 34 is first pivoted clockwise about the base 32 (in the present illustration). The clamping block 36 is then pivoted around the lever 34. This causes the clamping lug 37 to contact the heel part 40 of the ski boot 4.

Further pivoting of the clamping block 36 exerts a force on the heel part 40 of the ski boot 4. As soon as the clamping block 36 has been pivoted by a certain angular amount, the clamping hook 38 can be guided over the lever 34 and fixed or hooked in there. This permanently exerts a force through the clamping lug 37 on the heel part 40 of the ski boot 4, which fixes the ski boot 4 in place.

The acting force typically comprises two components, namely a force Fx in the direction of the boot's longitudinal axis X and a force Fz in the opposite direction to the ski surface normal Z, as shown in FIG. 5B. The force Fx presses the ski boot 4 or its web 44 into the hook system 23, so that the ski boot 4 is fixed in the direction of the longitudinal boot axis X. The force Fz presses the ski boot 4 or the heel part 40 in the direction of the ski 10 so that the heel part 40 cannot be lifted off the ski 1.

In particular, the descent mode is shown in FIG. 5B. In descent mode, the front jaw device 2 is open and the rear jaw device 3 is closed. In this case, the web 44 of the ski boot 4 is held in the hook system 23 of the front jaw device 2 and the heel part 40 of the ski boot 4 is fixed by the lever mechanism 30 of the rear jaw device 3.

In particular, the contact pressure of the lever mechanism 30 exerts a force on the heel part 40 of the ski boot, so that a force acts along the longitudinal axis X of the boot and the web 44 is pressed into the hook system 23 of the front jaw device 2. The ski boot 4 is thus secured against translation against the boot longitudinal axis X by the lever mechanism 30.

Figure 5C:
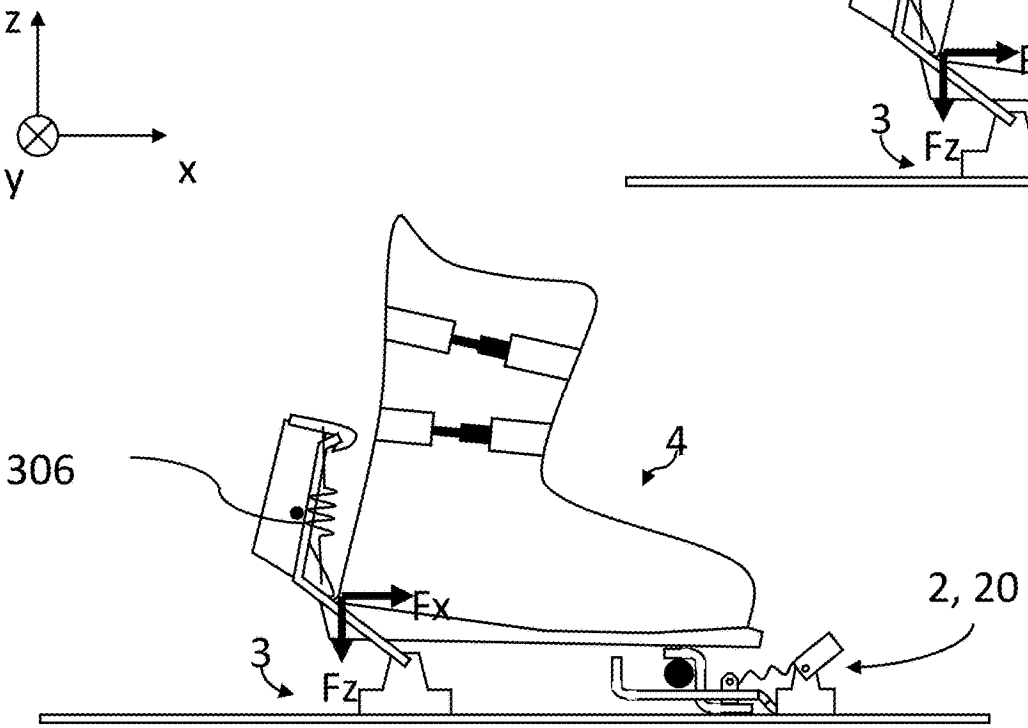

In order to reduce the risk of injury in the event of a fall, the rear jaw device 3 can have a safety release 306, as shown in FIGS. 5A to 5C. This allows the lever mechanism 30 to open, for example, when a predefined force is applied, so that the heel part 40 of the ski boot can be removed from the rear jaw device 3.

FIG. 5C shows an embodiment corresponding to that shown in FIG. 5B, whereby the front jaw device 2 corresponds to that shown in FIG. 3E. The force Fx in the direction of the longitudinal axis X of the shoe presses the web 44 into the retainer 21 and secures it against translation against the longitudinal axis X of the shoe. The spring of the front jaw spring mechanism 26 provides resistance against displacement of the retainer 21 in the direction of the longitudinal shoe axis X and has a safety mechanism. If the force Fx in the direction of the shoe's longitudinal axis X exceeds a predefined value, the mount 21 and the web 44 move along the shoe's longitudinal axis X to such an extent that the web 44 can detach from the mount 21.

Figure 6A:
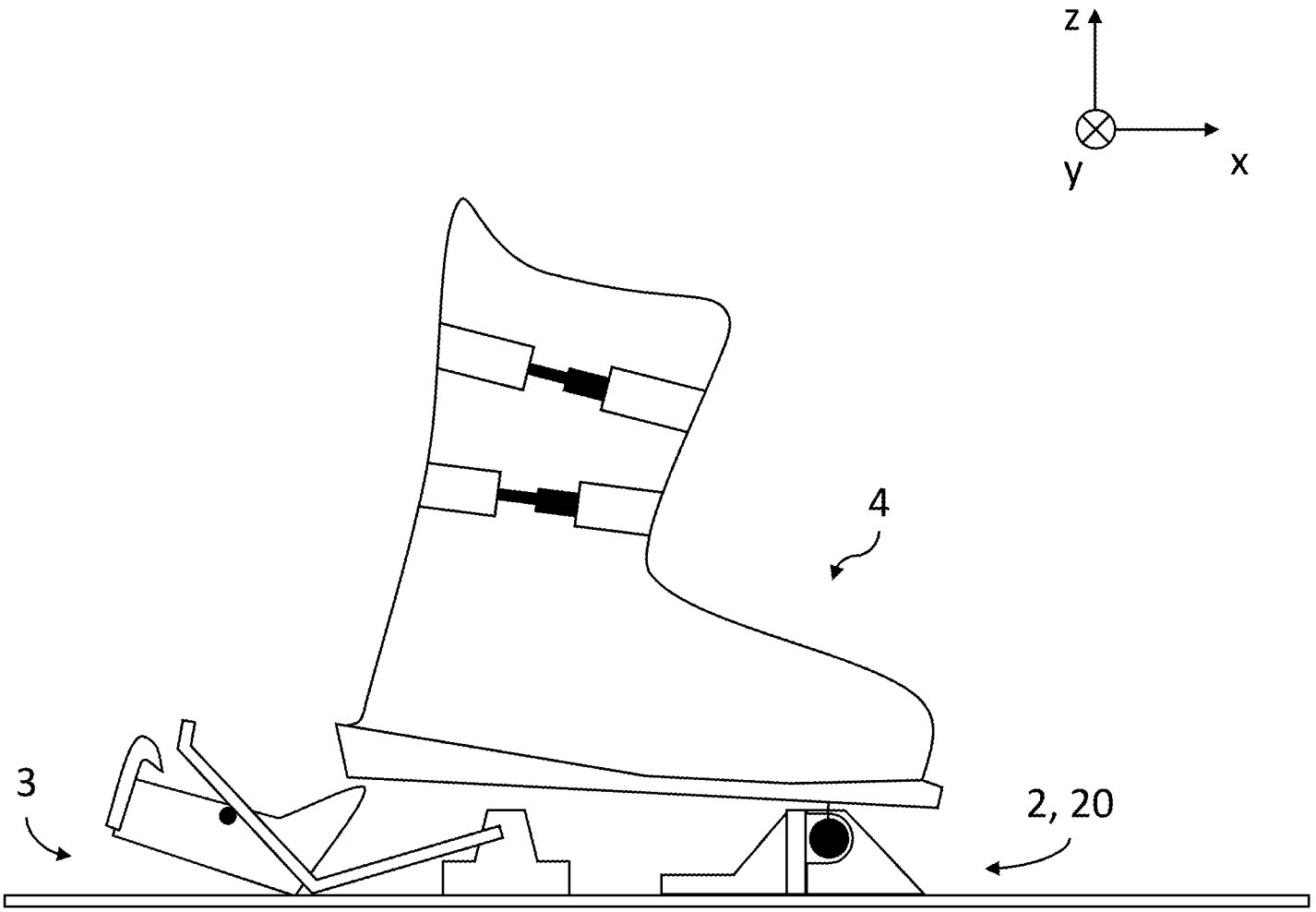
FIGS. 6A-6C schematic representations of the ascent mode.
Figure 6B:
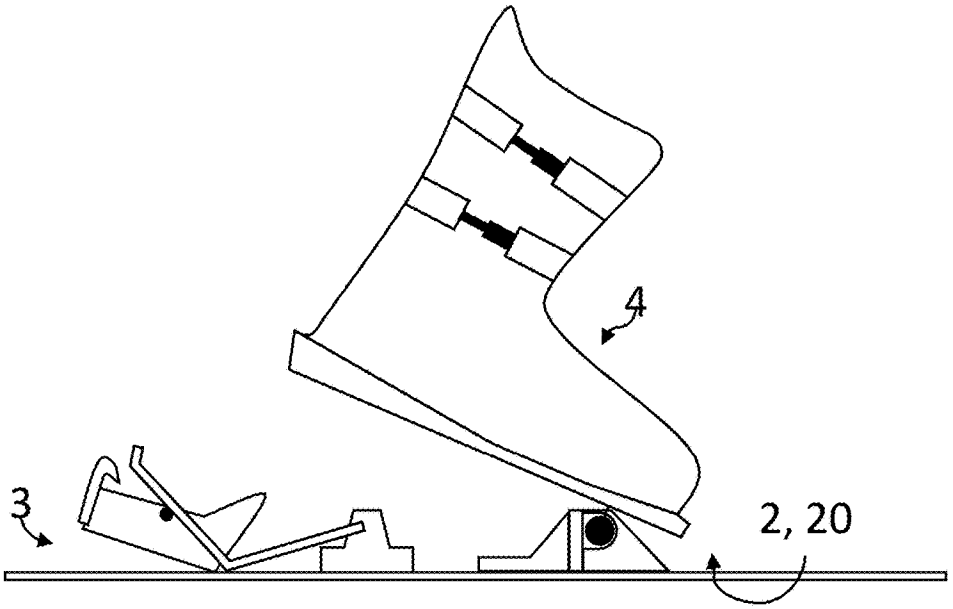

FIGS. 6A and 6B show the ascent mode of the binding system 1 for a touring ski binding. In the ascent mode, the rear jaw device 3 is open and the front jaw device 2 is closed. The web 44 of the ski boot 4 is rotatable locked by the hook system 23 of the front jaw device 2 and secured against translation against the longitudinal axis X of the boot by the locking system 27. The heel part 40 of the ski boot 4 is not fixed in the open state of the rear jaw device 3, so that the ski boot 4 can be rotated about the web axis Y. This is shown in particular in the comparison of FIGS. 6A and 6B.

Figure 6C:
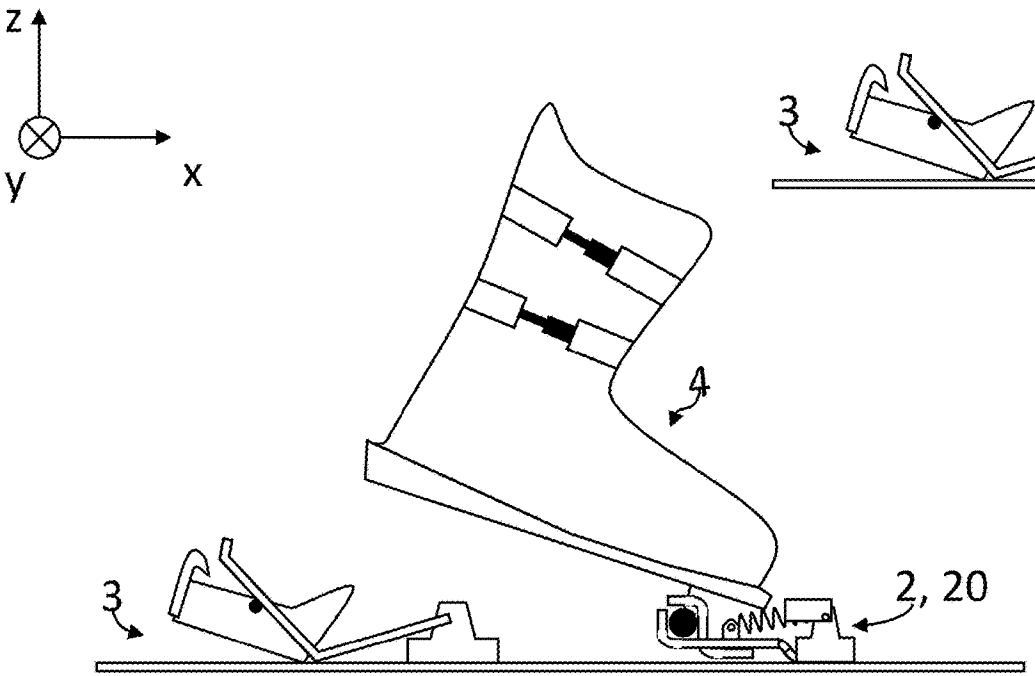

Furthermore, FIG. 6C shows an embodiment corresponding to that shown in FIGS. 6B, whereby the front baking device corresponds to that shown in FIG. 3E. The spring of the front jaw spring mechanism 26 presses the retainer 21 against the stop 25 of the locking system 27, so that the retainer 21 can lock the web 44 rotated about the web axis Y. In particular, it can be seen from a comparison of the descent and ascent modes in FIGS. 5A and 6A that the web 44 of the ski boot 4 is offset along the longitudinal axis X of the boot. Thus, a spatial separation of the ski binding modes can be realized by the displaceable retainer 21.

As far as applicable, all individual features shown in the embodiment examples can be combined and/or interchanged without leaving the scope of the invention.

LIST OF REFERENCE SYMBOLS

1 Binding system
10 Ski
2 Front jaw device
20 Holding device
21 Retainer
22 Hook-shaped receptacle
23 Hook system
24 Opening
25 Stroke
26 Front jaw spring mechanism
27 Locking system
28 Locking plate
29 Front jaw lever mechanism
3 Rear jaw device

30 Lever mechanism
32 Base
34 Lever
36 Clamping block
37 Clamping nose
38 Clamping hook
306 Safety release
4 Ski boot
40 Heel part
42 Front foot part
44 Web
X Boot longitudinal axis
Y Web axis
Z Ski surface normal

The invention claimed is:

1. Binding system for a touring ski binding, comprising a front jaw device and a rear jaw device for receiving a ski boot, wherein the ski boot has a heel part and a front foot part, wherein at least one web is arranged in or on the front foot part, wherein the web axis (Y) of the web runs perpendicular to the boot longitudinal axis (X), wherein the boot longitudinal axis (X) extends from the heel part to the front foot part, wherein the front jaw device comprises a holding device with a retainer and a locking system, wherein the retainer has a hook-shaped receptacle for receiving the web of the ski boot (4), which is aligned opposite the boot longitudinal axis (X), wherein the retainer at least partially surrounds the web and thus receives the web of the ski boot, wherein the locking system is configured to lock the web of the ski boot in the retainer rotatable about the web axis (Y), wherein the rear jaw device has a lever mechanism which is configured to fix the heel part of the ski boot, wherein in an ascent mode of the touring ski binding, the front jaw device is closed and the rear jaw device is open, wherein the retainer can lock the web of the ski boot rotatable and the locking system can secure the web against translation against the boot longitudinal axis (X), wherein the rear jaw device does not fix the heel part of the ski boot, so that the ski boot can be rotated about the web axis (Y), wherein in a descent mode, the front jaw device is open and the rear jaw device is closed, so that the retainer can receive the web of the ski boot, and the lever mechanism of the rear jaw device can fix the heel part of the ski boot, and wherein the rear jaw device with the lever mechanism exerts a contact pressure on the heel part of the ski boot along the boot longitudinal axis (X), so that the web is pressed into the retainer of the front jaw device, and the ski boot is thus secured against a translation against the boot longitudinal axis (X).

2. Binding system according to claim 1, wherein the locking system and the retainer are displaced relative to each other during locking.

3. Binding system of claim 2, wherein the locking system is stationarily attached to the ski and the retainer is displaceable.

4. Binding system of claim 3, wherein the front jaw device further comprises a front jaw lever mechanism, and wherein the retainer is displaceable by means of the front jaw lever mechanism.

5. Binding system of claim 4, wherein the front jaw device further comprises a front jaw spring mechanism, and wherein the retainer is displaceable by means of the front jaw spring mechanism.

6. Binding system according to claim 5, wherein the locking system has a stop, and wherein in ascent mode the retainer is pressed against the stop by means of the front jaw spring mechanism.

7. Binding system of claim 2 wherein the retainer is U-shaped or L-shaped.

8. Binding system of claim 2 wherein the locking system comprises a locking plate configured to at least partially cover the hook-shaped receptacle of the retainer.

9. Binding system of claim 2 wherein in ascent mode the web of the ski boot is offset along or against the boot longitudinal axis (X) compared to the descent mode.

10. Binding system of claim 2 wherein the rear jaw device comprises a safety release in descent mode.

11. Binding system claim 1, wherein the locking system is stationarily attached to the ski and the retainer (21) is displaceable.

12. Binding system of claim 11, wherein the front jaw device further comprises a front jaw lever mechanism, and wherein the retainer is displaceable by means of the front jaw lever mechanism.

13. Binding system of claim 12, wherein the front jaw device further comprises a front jaw spring mechanism, and wherein the retainer is displaceable by means of the front jaw spring mechanism.

14. Binding system of claim 13, wherein the locking system has a stop, and wherein in ascent mode the retainer is pressed against the stop by means of the front jaw spring mechanism.

15. Binding system of claim 11 wherein the locking system comprises a locking plate configured to at least partially cover the hook-shaped receptacle of the retainer.

16. Binding system of claim 11 wherein in ascent mode the web of the ski boot is offset along or against the boot longitudinal axis (X) compared to the descent mode.

17. Binding system of claim 1 wherein the retainer is U-shaped or L-shaped.

18. Binding system of claim 1 wherein the locking system comprises a locking plate configured to at least partially cover the hook-shaped receptacle of the retainer.

19. Binding system of claim 1 wherein in ascent mode the web of the ski boot is offset along or against the boot longitudinal axis (X) compared to the descent mode.

20. Binding system of claim 1 wherein the rear jaw device comprises a safety release in descent mode.

* * * * *